US011347179B2

(12) United States Patent
Fukase et al.

(10) Patent No.: US 11,347,179 B2
(45) Date of Patent: May 31, 2022

(54) IMAGE FORMING APPARATUS WITH CONTROL OF TRANSFER AND FIXING NIPS

(71) Applicant: CANON KABUSHIKI KAISHA, Tokyo (JP)

(72) Inventors: Yasuhiro Fukase, Kanagawa (JP); Akinori Mitsumata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/355,758

(22) Filed: Jun. 23, 2021

(65) Prior Publication Data

US 2021/0405576 A1 Dec. 30, 2021

(30) Foreign Application Priority Data

Jun. 24, 2020 (JP) ..... JP2020-109097

(51) Int. Cl.
*G03G 21/16* (2006.01)
*G03G 15/00* (2006.01)

(52) U.S. Cl.
CPC ..... *G03G 21/1647* (2013.01); *G03G 15/50* (2013.01); *G03G 21/168* (2013.01); *G03G 21/1638* (2013.01)

(58) Field of Classification Search
CPC .. G03G 15/50; G03G 15/657; G03G 21/1638; G03G 21/1647; G03G 21/168; G03G 2221/1675
See application file for complete search history.

(56) References Cited

U.S. PATENT DOCUMENTS 4,760,411 A * 7/1988 Ohmura ..... G03G 21/1647 347/152
5,587,769 A * 12/1996 Sawada ..... G03G 21/1638 399/101

(Continued)

FOREIGN PATENT DOCUMENTS

JP 2004-045604 A 2/2004
JP 2009-294357 A 12/2009

(Continued)

OTHER PUBLICATIONS

U.S. Appl. No. 17/355,745, Yasuhiro Fukase, Akinori Mitsumata, filed Jun. 23, 2021.

*Primary Examiner* — Sophia S Chen
(74) *Attorney, Agent, or Firm* — Venable LLP

(57) ABSTRACT

An image forming apparatus includes a transfer nip control member being movable to a pressing position, where a pressing force for positioning a transfer roller in a transfer nip releasing position is applied to a transfer unit in a closed position, and to a releasing position, where application of the pressing force is released; a fixing nip control mechanism for changing a relative position between a fixing roller and an opposing member to a fixing position, where a fixing nip is formed, and to a fixing nip releasing position; and an interlocking mechanism for moving the transfer nip control member in the releasing position to the pressing position in conjunction with a fixing nip releasing operation by the fixing nip control mechanism. The transfer nip control member in the pressing position is moved to the releasing position when the transfer unit is moved from the closed position to an open position.

10 Claims, 9 Drawing Sheets

(56) References Cited

U.S. PATENT DOCUMENTS

| | | | | |
|---|---|---|---|---|
| 2006/0188291 | A1* | 8/2006 | Kawakami | G03G 15/657 399/167 |
| 2014/0140727 | A1* | 5/2014 | Shimoi | G03G 21/168 399/121 |
| 2015/0220050 | A1* | 8/2015 | Fukase | G03G 21/1647 399/110 |

FOREIGN PATENT DOCUMENTS

| | | | |
|---|---|---|---|
| JP | 2014-122960 | A | 7/2014 |
| JP | 2015-212718 | A | 11/2015 |

* cited by examiner

IMAGE FORMING APPARATUS WITH CONTROL OF TRANSFER AND FIXING NIPS

BACKGROUND OF THE INVENTION

Field of the Invention

The present invention relates to an image forming apparatus, which uses an electrophotographic system or an electrostatic recording system, such as a copying machine, a multifunction machine, and a laser beam printer.

Description of the Related Art

There has been conventionally known a configuration of the above image forming apparatus in which a transfer roller serving as a transfer member is abutted against a photosensitive drum serving as an image bearing member, which carries a toner image, via a conveying belt, an intermediate transfer belt, or the like during image formation. When the transfer roller is stored in a state in which the transfer roller is abutted against the photosensitive drum, the conveying belt, the intermediate transfer belt, or the like provided at a position opposed to the transfer roller for an extended period of time, the shape of the transfer belt, the conveying belt, or the intermediate transfer belt may be locally deformed by a transfer pressure.

To avoid the above local deformation, there have been proposed configurations such as a configuration in which the transfer roller is separated from the opposing member such as the photosensitive drum, the conveying belt, the intermediate transfer belt, or the like, a configuration in which a lower transfer pressure is applied, etc.

Japanese Patent Application Publication No. 2009-294357 discloses a configuration in which a photosensitive drum and a transfer belt are separated from each other by rotating a cam when the apparatus is stopped and a configuration in which a transfer unit is supported by a door that is openable and closable so that, when jamming occurs, a jammed recording material can be easily removed. If the rotation of the cam is stopped in a state where the transfer belt is separated when the door is opened, a load generated when the door is closed increases. Japanese Patent Application Publication No. 2009-294357 discloses a configuration that reduces such a load. More specifically, in Japanese Patent Application Publication No. 2009-294357 the load generated by closing the door is reduced by providing a mechanism that moves the cam along with the operation of opening the door so as to reduce the load applied to the door.

SUMMARY OF THE INVENTION

However, with the configuration disclosed in Japanese Patent Application Publication No. 2009-294357, a space for providing the mechanism for reducing the load generated by closing the door needs to be additionally made in the apparatus. This makes it difficult to achieve downsizing and space saving of the apparatus.

With the foregoing in view, it is an object of the present invention to provide an image forming apparatus including a transfer unit that is openable and closable to expose the inside of the apparatus and to reduce a load generated when the transfer unit is closed without increasing the size of the apparatus.

To achieve the above object, the image forming apparatus according to the present invention includes the following:

an apparatus main body of the image forming apparatus;

an image bearing member that is provided in the apparatus main body and that carries a toner image;

a transfer roller that forms a transfer nip between the transfer roller and the image bearing member to sandwich a recording material in the apparatus main body and that transfers the toner image onto the recording material;

a transfer unit that is provided in the apparatus main body to be movable to an open position in which an inside of the apparatus main body is exposed and to a closed position in which the inside of the apparatus main body is closed, and that supports the transfer roller to be movable to a transfer position in which the transfer nip is formed between the transfer roller and the image bearing member and to a transfer nip releasing position in which the transfer nip is not formed, while the transfer unit is in the closed position;

a transfer nip control member that is provided in the apparatus main body to be movable to a pressing position in which a pressing force that positions the transfer roller in the transfer nip releasing position is applied to the transfer unit in the closed position and to a releasing position in which application of the pressing force is released;

a fixing portion that includes a fixing roller which forms a fixing nip to sandwich the recording material and an opposing member which is opposed to the fixing roller, and that fixes the toner image onto the recording material; and a fixing nip control mechanism that changes a relative position between the fixing roller and the opposing member to a fixing position in which the fixing nip is formed and to a fixing nip releasing position in which the fixing nip is not formed, wherein the image forming apparatus includes an interlocking mechanism that moves the transfer nip control member from the releasing position to the pressing position in conjunction with a fixing nip releasing operation by the fixing nip control mechanism, and wherein, when the transfer unit moves from the closed position to the open position in a state where the transfer nip control member is in the pressing position, the transfer nip control member moves from the pressing position to the releasing position.

As described above, according to the present invention, in the image forming apparatus including the transfer unit that is openable and closable to expose the inside of the apparatus, the load generated when the transfer unit is closed can be reduced without increasing the size of the apparatus.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 8:
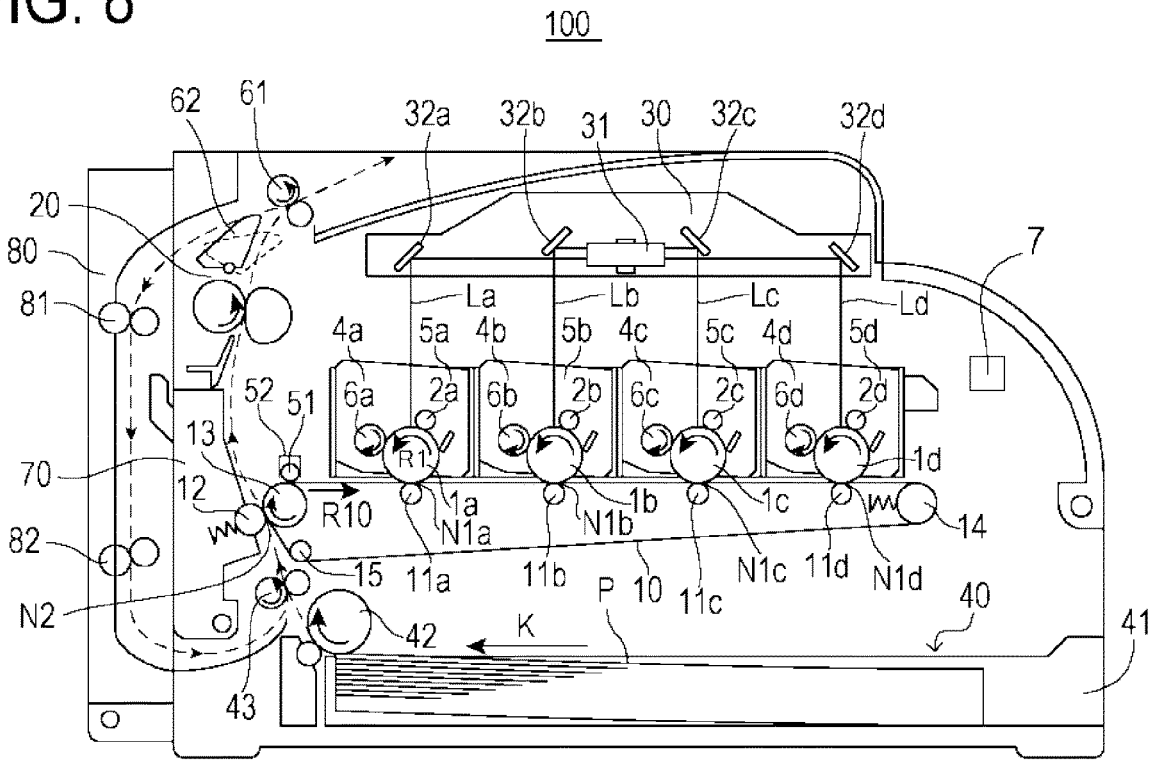
FIG. 8 is a schematic diagram illustrating a configuration of an image forming apparatus according to Embodiment 1.

FIG. 8 is a schematic diagram illustrating a configuration of an image forming apparatus 100 according to the present invention. The image forming apparatus illustrated in FIG. 8 is a tandem-type four-color laser beam printer based on an electrophotographic system and uses an intermediate transfer belt 10. Hereinafter, a configuration of the image forming apparatus 100 will be briefly described.

The image forming apparatus 100 illustrated in FIG. 8 includes drum-shaped electrophotographic photosensitive members (hereinafter, referred to as "photosensitive drums") 1*a* to 1*d* as first image bearing members for respective colors in a main body of the apparatus. The photosensitive drums 1*a* to 1*d* are rotatably supported by the image forming apparatus 100 and driven to rotate in an arrow R1 direction by a drive unit (not illustrated). Contact-type charging rollers 2*a* to 2*d* and developing devices 4*a* to 4*d* are arranged around the photosensitive drums 1*a* to 1*d*, respectively, along a rotational direction thereof. The charging rollers 2*a* to 2*d* uniformly charge the surfaces of the photosensitive drums 1*a* to 1*d*, respectively. The developing devices 4*a* to 4*d* each develop an electrostatic latent image into a toner image by depositing toner on the electrostatic latent image by using developing rollers 6*a* to 6*d*, respectively. In addition, an exposure device 30 is disposed in the upper portion of each of the photosensitive drums 1*a* to 1*d*. The exposure device 30 irradiates the surfaces of the photosensitive drums 1*a* to 1*d* with laser beams La to Ld, respectively, to form electrostatic latent images based on image information. Further, an intermediate transfer belt (intermediate transfer member) 10 is disposed in contact with the photosensitive drums 1*a* to 1*d* as a second image bearing member onto which the toner images on the photosensitive drums 1*a* to 1*d* are primary-transferred. Photosensitive drum cleaning devices 5*a* to 5*d* are arranged to remove primary-transfer residual toner on the surfaces of the photosensitive drums 1*a* to 1*d*. Furthermore, a control portion 7 is provided as unit for controlling operations of the image forming apparatus 100 and exchanges various electrical information signals. In the following descriptions, if the components denoted by the reference characters a to d have a common functional configuration, the reference characters a to d will be omitted.

A primary transfer roller 11 is arranged on the inner peripheral surface of the intermediate transfer belt 10. The primary transfer roller 11 presses the intermediate transfer belt 10 against the surface of the photosensitive drum 1 and forms a primary transfer nip portion N1 between the photosensitive drum 1 and the intermediate transfer belt 10 to sandwich a transferred material P. A primary transfer bias is applied to the primary transfer roller 11 by a power source (not illustrated). A secondary transfer roller 12 is disposed on the outer surface side of the intermediate transfer belt 10, namely, at a position opposed to a driver roller 13 (opposing roller) which is disposed on the inner surface side of the intermediate transfer belt 10, and a secondary transfer nip portion N2 is formed between the secondary transfer roller 12 and the intermediate transfer belt 10. A secondary transfer bias is applied to the secondary transfer roller 12 by the power source (not illustrated). In addition, the image forming apparatus of the present embodiment can measure a current value in an image forming process, which will be described below. By using the measured current value, the above-described control portion 7 also functions as a determining unit for determining a position of the secondary transfer roller 12, for example.

Further, a cleaning roller (roller charging device) 51 of an electrostatic intermediate transfer belt cleaning device 52 is provided opposite to the outer peripheral surface of the intermediate transfer belt 10 on the downstream side of the secondary transfer nip portion N2 and the upstream side of the primary transfer nip portion N1.

A transferred material feeding device 40 feeds a transferred material P to the image forming portion that includes the photosensitive drum 1, the charging roller 2, the developing roller 6, the exposure device 30, the photosensitive drum cleaning device 5, etc. The transferred material feeding device 40 includes a transferred material cassette 41 accommodating a plurality of transferred materials (recording materials) P, a feeding roller 42, a registration roller 43, etc.

On the downstream side of the secondary transfer nip portion N2 in the conveying direction (arrow K direction) of the transferred material P, a fixing unit 20 in which a toner image transferred onto the transferred material P is heated and pressed to be fixed is provided.

The image forming apparatus 100 having the above configuration will be described in detail below. The photosensitive drum 1 described above is formed of an aluminum cylinder and a photoconductive layer such as an OPC (organic photo conductor) provided on the outer peripheral surface of the aluminum cylinder. The charging roller 2 is formed of a core metal and a conductive elastic member surrounding the core metal. The charging roller 2 is disposed in contact with the surface of the photosensitive drum 1 and driven to rotate by the rotation of the photosensitive drum 1. A charging bias is applied to the charging roller 2 by the power source (not illustrated).

The exposure device 30 includes a laser oscillator (not illustrated) that emits a laser beam L based on image information, a polygon mirror 31, a mirror 32, etc., and exposes the surface of the charged photosensitive drum 1 to the laser beam L based on the image information to form an electrostatic latent image. The developing device 4 is disposed in a development position opposed to the surface of the photosensitive drum 1 to perform development of the electrostatic latent image on the photosensitive drum 1. The electrostatic latent image is then developed on the photosensitive drum 1 and forms a toner image. This developing process is performed on each color.

The intermediate transfer belt 10 is formed in an endless shape and extended around three supporting rollers arranged in parallel to each other, which are the driver roller 13, a tension roller 14, and an assisting roller 15. The tension roller 14 is driven to rotate and stretches the intermediate transfer belt 10. The intermediate transfer belt 10 is driven (runs) in an arrow R10 direction by the rotation of the driver roller 13 rotated by drive unit (not illustrated).

Next, an operation of the image forming apparatus having the above configuration will be described. The surface of the photosensitive drum 1*a* driven to rotate in the arrow R10 direction is uniformly charged by the charging roller 2*a* to which a charging bias, in which DC voltage and AC voltage are superimposed to each other, is applied. When a yellow image signal is input to the laser oscillator (not illustrated), the surface of the charged photosensitive drum 1*a* is irradiated with the laser beam La so that an electrostatic latent image is formed. When the photosensitive drum 1*a* further rotates in the arrow R1 direction, the yellow developing device 4*a* causes yellow toner to adhere to the electrostatic latent image on the photosensitive drum 1*a* to develop the electrostatic latent image as a toner image. The yellow toner image on the photosensitive drum 1*a* is primary-transferred onto the intermediate transfer belt 10 via the primary transfer nip portion N1*a* by a primary transfer bias applied to the primary transfer roller 11*a*. After the transfer of the yellow toner image, primary-transfer residual toner on the surface of the photosensitive drum 1*a* is removed by the photosensitive drum cleaning device 5*a*, and the photosensitive drum 1*a* is then ready for the next image formation.

A series of image forming processes of charging, exposure, development, primary transfer, and cleaning described above is repetitively performed for each of the other three colors, which are magenta, cyan, and black in consideration of intervals of the primary transfer nip portions N1*a* to N1*d*. A toner image in four colors is then formed on the intermediate transfer belt 10.

This four-color toner image on the intermediate transfer belt 10 is secondary-transferred onto the transferred material P conveyed in the arrow K direction via the secondary transfer nip portion N2 by a secondary transfer bias applied to the secondary transfer roller 12 by the power source.

The transferred material P onto which the toner image has been transferred at the secondary transfer nip portion N2 is conveyed to the fixing unit 20 where the toner image is heated and pressed to be melt-fixed (fixed). A full-color image of four colors is thereby obtained on the transferred material P. Next, the transferred material P is discharged by a paper discharge reverse roller 61.

To perform double-sided printing, when the rear end portion of the transferred material P has reached the paper discharge reverse roller 61, a flapper 62 is moved to a double-side convey position by a drive unit (not illustrated). The paper discharge reverse roller 61 is then reversely rotated by a drive unit (not illustrated) to convey the recording material P to a double-side unit 80. Next, an upper roller 81 and a lower roller 82 convey the transferred material P to the registration roller 43. A second surface (the other surface) of the transferred material P is then printed in the same manner as the first surface printing, and the recording material P is discharged.

On the intermediate transfer belt 10 after the transfer of the toner image, secondary-transfer residual toner that has not been transferred onto the transferred material P remains. The residual toner on the intermediate transfer belt 10 is collected in the photosensitive drum cleaning devices 5*a* to 5*d* via the photosensitive drums 1*a* to 1*d* by the intermediate transfer belt cleaning device 52. That is, electric charges of an opposite polarity, namely, positive charges are applied to the residual toner by the intermediate transfer belt cleaning unit so that the residual toner is reverse-transferred onto the photosensitive drums 1*a* to 1*d* via the primary transfer nip portions N1*a* to N1*d*. The photosensitive drum cleaning devices 5*a* to 5*d* remove secondary-transfer residual toner that has been reverse-transferred, together with the primary-transfer residual toner on the photosensitive drums 1*a* to 1*d*.

Next, a configuration specific to the present embodiment will be described with reference to FIGS. 1, 2A to 2C, 3A to 3E, 4A 4B to 8.

Figure 1:
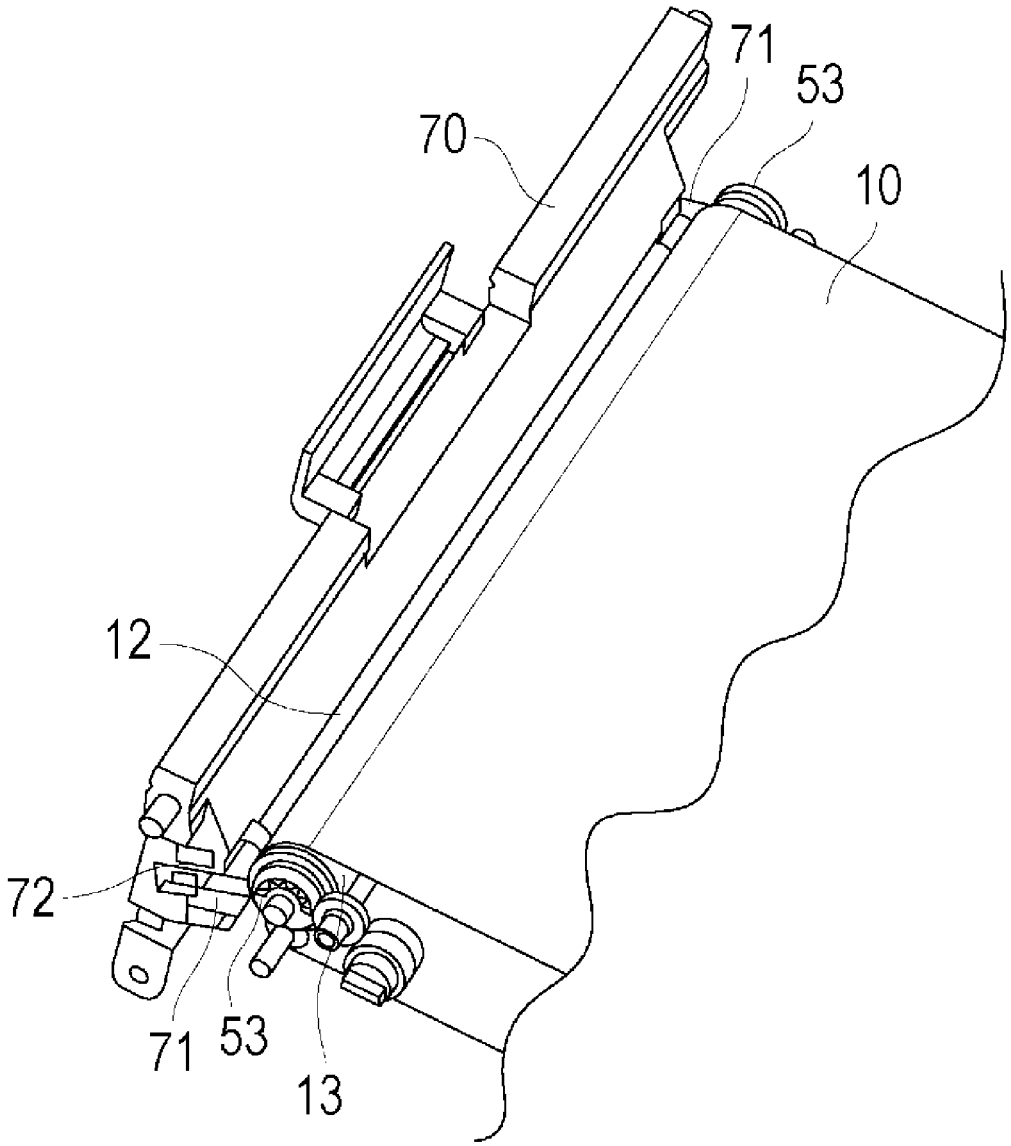
FIG. 1 is a diagram illustrating the vicinity of a secondary transfer roller according to Embodiment 1.

FIG. 1 is a diagram illustrating the vicinity of the secondary transfer roller 12 of the image forming apparatus 100 according to the present embodiment. Separation cams 53 for separating the secondary transfer roller 12 are provided near both ends of the intermediate transfer belt 10, which is coaxial with the driver roller 13.

The secondary transfer unit 70 includes the secondary transfer roller 12 and bearings 71 each of which is provided at each end of the secondary transfer roller 12 and has a surface to be in contact with a corresponding one of the separation cams 53 described below. One of the bearings 71 at both ends of the secondary transfer roller 12 is provided with a conductive member (not illustrated) for applying a bias to the secondary transfer roller 12. Thus, this bearing 71 is not a component identical to the other bearing 71. The secondary transfer roller 12 is pressed by a secondary transfer spring 72 serving as a transfer biasing member via the bearing 71 and the conductive member (not illustrated), and the secondary transfer unit 70 receives a reaction force of the secondary transfer spring 72. The secondary transfer unit 70 is configured to be turnable (movable between a closed position that closes the inside of the apparatus main body and an open position that exposes the inside of the apparatus main body) so that the secondary transfer unit 70 can be opened and closed with respect to the main body of the image forming apparatus 100. When a paper jam or the like occurs, the inside of the apparatus main body can be exposed by moving the secondary transfer unit 70 to the open position so as to allow a user to handle the paper jam.

By turning the separation cams 53 serving as a transfer nip control member while the secondary transfer unit 70 is closed, the bearings 71 move forward or backward against a bias force of the secondary transfer spring 72 by the pressing force received from the separation cams 53. This allows the secondary transfer roller 12 to move to a contact position (transfer position) and to a separation position (transfer nip releasing position).

Figure 2A:
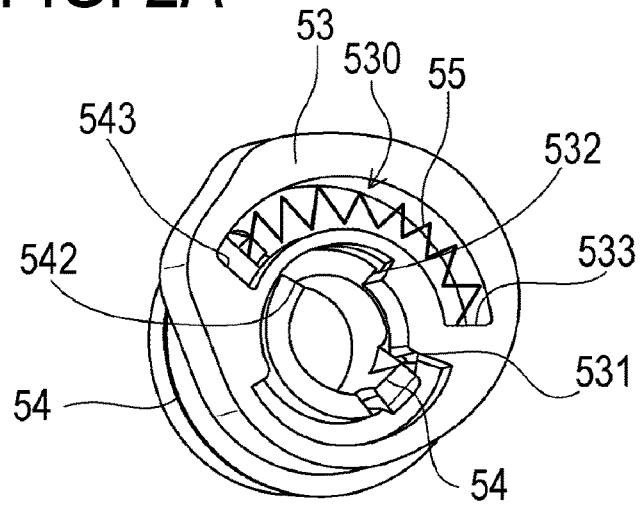
FIGS. 2A to 2C illustrate a configuration of a separation cam according to Embodiment 1.
Figure 2B:
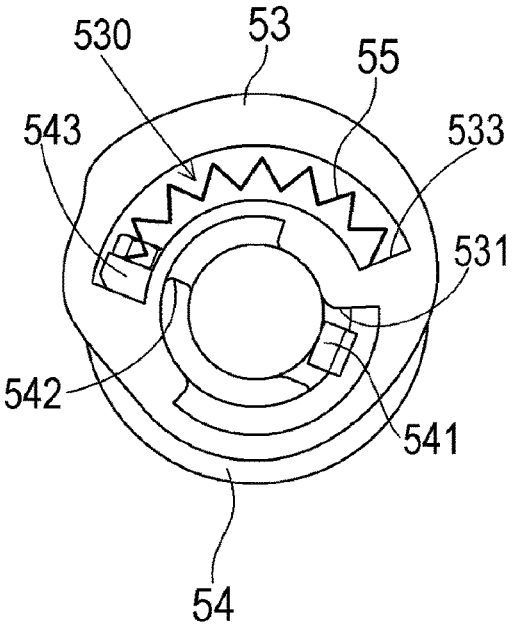
Figure 2C:
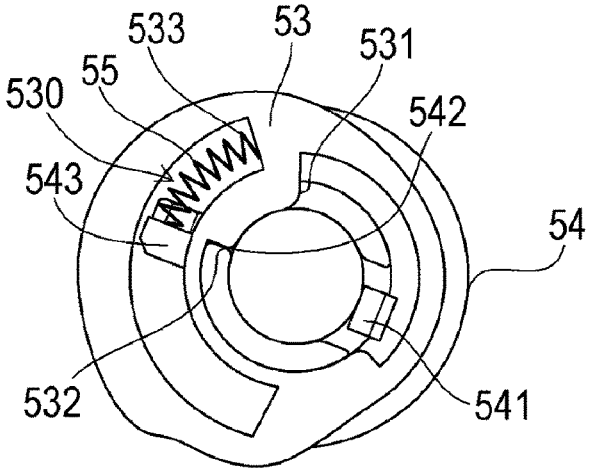

A configuration of the individual separation cam 53 will be described with reference to FIGS. 2A to 2C. The separation cam 53 is composed of the separation cam 53, a separation cam receiver 54, and a cam spring 55 (FIG. 2A). A predetermined space is provided in a rotational direction between the separation cam 53 serving as a cam member that rotates around a rotational axis and the separation cam receiver 54 serving as a cam-receiving member that are integrally assembled to the same axis. In this space, the cam spring 55 serving as a biasing member is assembled and configured to generate a biasing force in the rotational direction of the separation cam 53 (FIG. 2B). A state in which the space between the separation cam 53 and the separation cam receiver 54 is the smallest (a state in which the biasing pressure of the cam spring 55 is the highest) is illustrated in FIG. 2C.

More specifically, the cam spring 55 is disposed in a circular arc-shaped spring accommodation hole 530 formed in the separation cam 53. One end of the cam spring 55 is assembled to a spring receiver 533 of the separation cam 53 and the other end is assembled to a spring-receiving projection 543 of the separation cam receiver 54 inserted in the spring accommodation hole 530. When the separation cam 53 and the separation cam receiver 54 rotate relative to each other, the position of the spring-receiving projection 543 in the spring accommodation hole 530 changes, and the compressed state of the cam spring 55 by the spring receiver 533 and the spring-receiving projection 543 changes. This changes a biasing force generated between the separation cam 53 and the separation cam receiver 54 by the cam spring 55. That is, the configuration including the separation cam receiver 54 and the cam spring 55 that generates a biasing force between the separation cam 53 and the separation cam receiver 54 corresponds to biasing unit with respect to the separation cam 53 in the present embodiment.

In addition, the separation cam 53 and the separation cam receiver 54 each have a configuration for regulating the amount of rotation relative to each other to a predetermined range. That is, the separation cam 53 includes a first regulating surface 531 and a second regulating surface 532, and the separation cam receiver 54 includes a first regulating projection 541 and a second regulating projection 542. The first regulating surface 531 and the first regulating projection 541 are contactable to each other in one of the rotational directions relative to the separation cam 53 and the separation cam receiver 54. The second regulating surface 532 and the second regulating projection 542 are contactable to each other in the other direction of the above relative rotational direction. For example, viewed from the separation cam 53, clockwise rotation of the separation cam 53 with respect to the separation cam receiver 54 as illustrated in FIG. 2B is regulated when the first regulating surface 531 comes in contact with the first regulating projection 541, and counterclockwise rotation is regulated when the second regulating surface 532 comes in contact with the second regulating projection 542.

Next, contact and separation of the secondary transfer roller 12 will be described with reference to FIGS. 3A to 3E. A separation gear 58 is engaged with the above-described separation cam receiver 54 as illustrated in FIGS. 3A to 3E and supports the rotation of the separation cam receiver 54. In addition, the separation gear 58 controls the rotational phase of the separation cam receiver 54 by rotating the separation cam receiver 54 along with the rotation of the separation gear 58. In a printable state where the secondary transfer roller 12 is closed (FIG. 3A), rotating the separation gear 58 in an arrow direction rotates the separation cam receiver 54 and the separation cam 53 by 180 degrees. Rotating the separation cam receiver 54 engaged with the separation gear 58 compresses the cam spring 55, as described above. After the cam spring 55 is compressed, the separation cam 53 also rotates along with the rotation of the separation cam receiver 54 and stops rotating at a position illustrated in FIG. 3C.

Figure 3A:
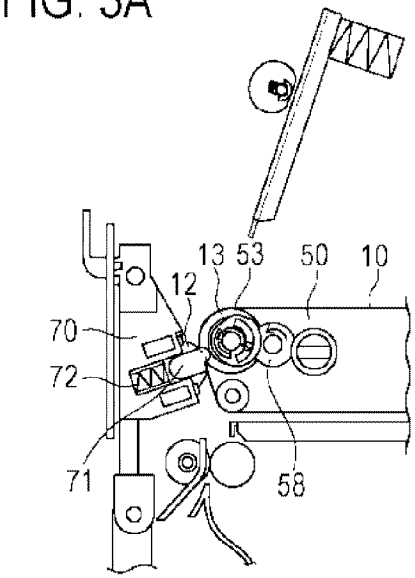
FIGS. 3A to 3E are schematic diagrams illustrating contact and separation of the secondary transfer roller according to Embodiment 1.
Figure 3B:
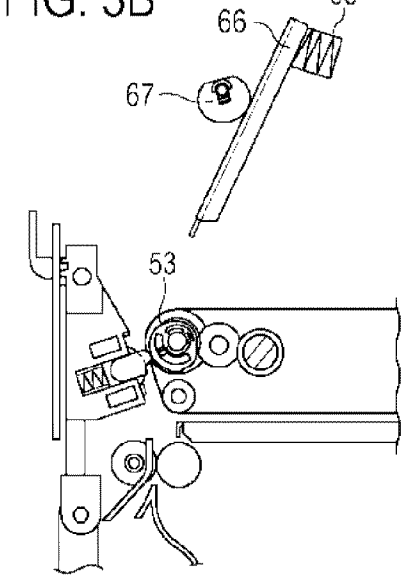
Figure 3C:
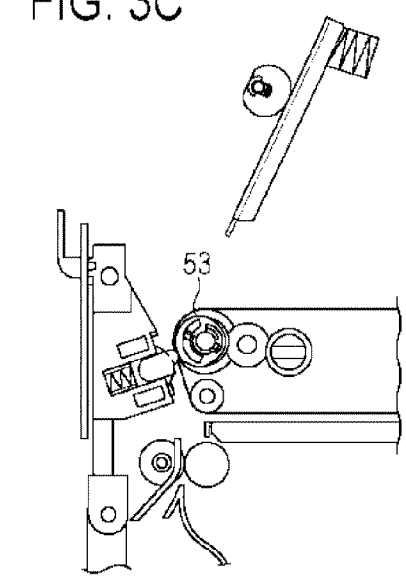

At this point, the separation cam 53 is regulated from rotating in the clockwise direction by a biasing force from the bearing 71 biased by the secondary transfer spring 72 and positioned in the state as illustrated in FIG. 3C. Thus, the bearing 71 is pressed and retracted by the separation cam 53, and the secondary transfer roller 12 moves to the separation position where the secondary transfer roller 12 is separated from the intermediate transfer belt 10. Here, in the state illustrated in FIG. 3C, that is, a state where the separation cam 53 and the bearing 71 are biased toward each other and the secondary transfer roller 12 is thereby positioned at the separation position, the bearing 71 receiving the biasing force from the secondary transfer spring 72 functions as a regulating member for regulating the rotation of the separation cam 53. When the secondary transfer roller 12 has been separated from the intermediate transfer belt 10, the secondary transfer spring 72 is compressed by this separation. This increases the reaction force of the spring received by the secondary transfer unit 70. At this point, the separation cam 53 and the separation cam receiver 54 are in contact with each other on the side where the space in between is the smallest with respect to the rotational direction of the separation cam 53 (FIG. 2C). This position is used at the time of shipment from the factory, at the time of long-term storage during use by a user, at the time of handling a paper jam, etc.

Figure 3D:
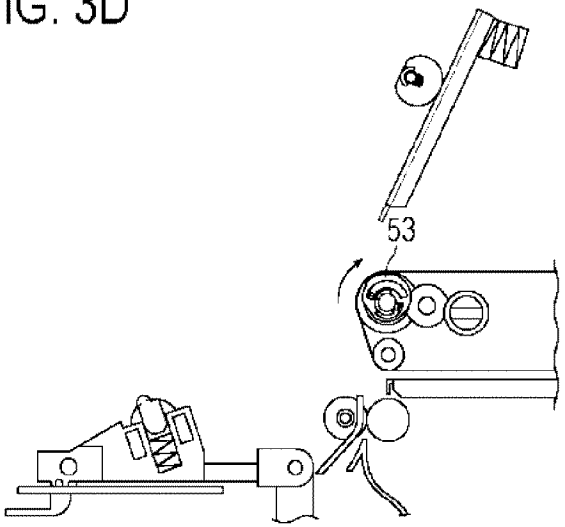
Figure 3E:
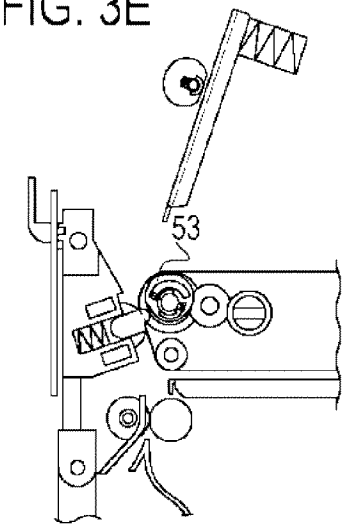

When a paper jam is handled, the separation cam 53 and the bearing 71 are separated by opening the secondary transfer unit 70, and the biasing force applied to the separation cam 53 by the bearing 71 is released. As a result, the separation cam 53 rotates with respect to the separation cam receiver 54 positioned by being engaged with the separation gear 58 by the biasing force applied by the cam spring 55 in a compressed state (FIG. 3D). The separation cam 53 after the rotation is approximately in the contact position in which the secondary transfer roller 12 is to be in contact with the intermediate transfer belt 10 when the secondary transfer unit 70 is closed. The separation cam 53 continues to rotate until the cam spring 55 is in a stretched state. In contrast, since the separation cam receiver 54 is engaged with the separation gear 58, the separation cam receiver 54 does not rotate along with the separation cam 53 and is fixed in position.

When the secondary transfer unit 70 is closed after the paper jam is handled (FIG. 3E), as described above, the phase (position) of the separation cam 53 is in the contact position that allows the secondary transfer roller 12 to be in contact with the intermediate transfer belt 10. In other words, the separation cam 53 having a cam shape applies a pressing force to the bearing 71 to move the secondary transfer roller 12 from a pressing phase (pressing position), where the secondary transfer roller 12 is positioned in a transfer nip releasing position, to a releasing phase (releasing position), where the pressing force is released. Thus, when the secondary transfer unit 70 is closed, the bearing 71 does not come in contact with the separation cam 53. Consequently, the separation cam 53 does not receive a pressing force from the secondary transfer spring 72 via the bearing 71. For example, in a configuration in which the separation cam 53 stays in the pressing phase when the secondary transfer unit 70 is opened, the bearing 71 receiving a biasing force from the secondary transfer spring 72 and the separation cam 53 are biased toward each other when the secondary transfer unit 70 is closed. In such a case, an operating force generated when the secondary transfer unit 70 is closed is larger than that in the configuration of the present embodiment. In contrast, with the configuration of the present embodiment, when the secondary transfer unit 70 is closed, a reaction force generated by a pressing force applied to the bearing 71 by the separation cam 53 is not added to an operating force. Thus, compared to the above comparative configuration, the operating force generated when the secondary transfer unit 70 is closed is smaller.

When the separation gear 58 is rotated again, the cam spring 55, which has been in the stretched state by the rotation of the separation cam receiver 54 engaged with the separation gear 58, is compressed again. The separation cam 53 then rotates along with the rotation of the separation cam receiver 54 and stops rotating at the position illustrated in FIG. 3C so that the secondary transfer roller 12 can be separated from the intermediate transfer belt 10 again.

Figure 9:
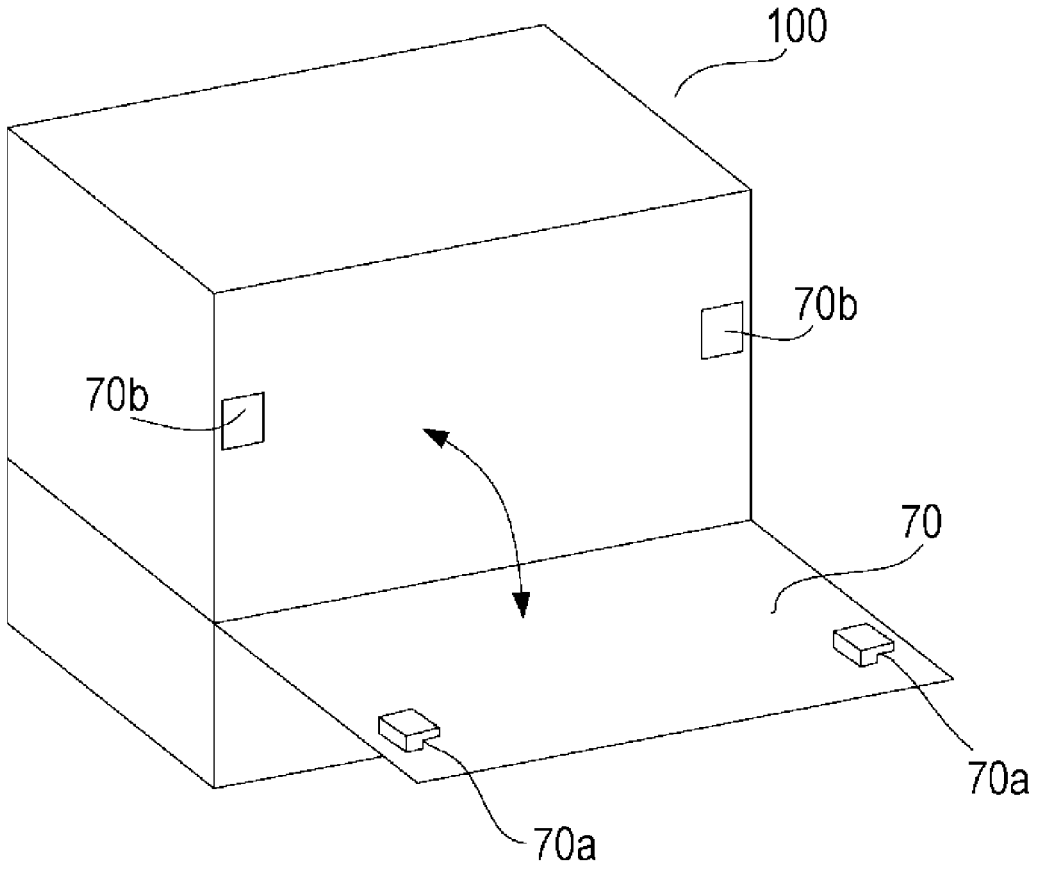
FIG. 9 illustrates a lock mechanism of the secondary transfer unit according to Embodiment 1.

A locking mechanism that can lock the secondary transfer unit 70 according to the present embodiment in the above-described closed position will be described with reference to FIG. 9. In the secondary transfer unit 70, a latch 70*a* serving as an engaging portion is provided one each (two in total) at a location corresponding to a lock unit 70*b* (engaged portion) on the apparatus body side. When the secondary transfer unit 70 is moved from the open position to the closed position, each of the latches 70*a* engages with a corresponding one of the lock units 70*b* and reaches an engaged position. The secondary transfer unit 70 is thereby locked in the closed position. As described above, the locking mechanism for holding the secondary transfer unit 70 in the closed state is provided near each end of the secondary transfer unit 70, and since there is no increase in reaction force, there is no change in locking performance.

Figure 4B:
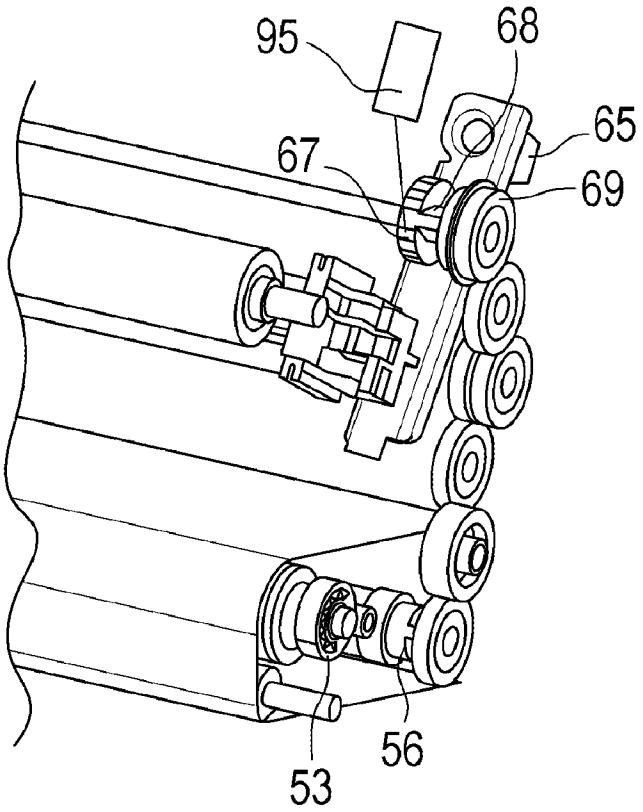
FIGS. 4A and 4B illustrate a drive configuration of the separation cam according to Embodiment 1.
Figure 4A:
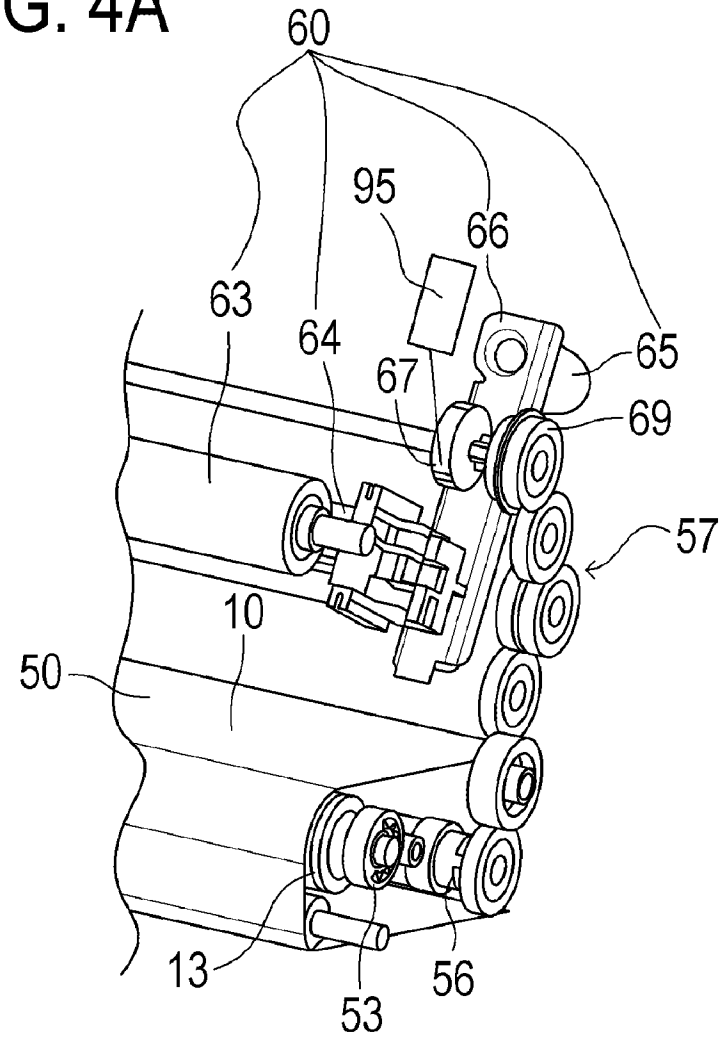

Next, a drive configuration of the separation cam 53 will be described with reference to FIGS. 4A and 4B. In a fixing unit 60 (fixing portion), a fixing nip that sandwiches a transferred material P is formed by a fixing roller 63 and a heating member 64 serving as an opposing member to oppose to the fixing roller 63, and a fixing spring 65 serving as a fixing bias member presses a pressure plate 66 to apply pressure to the heating member 64. A toner image is then heated to be melt-fixed (fixed). For handling a paper jam or for a long-term storage, the fixing cam 67 serving as a fixing cam member is rotated 180 degrees to turn the pressure plate 66, as a fixing nip control mechanism. By using this mechanism, the relative position between the fixing roller 63 and the heating member 64 is periodically changed from a fixing position in which the fixing nip is formed to a fixing nip releasing position so as to release (or reduce) a fixing nip pressure.

The image forming apparatus 100 according to the present embodiment includes an interlocking mechanism that moves the separation cam 53 from the releasing position to the pressing position in conjunction with the fixing nip releasing operation by the fixing nip control mechanism. A drive transmission portion 68 is provided on the axis driving the fixing cam 67 and engages at a driven transmission portion 69 having a gear provided to its body. A driving force is transmitted from the driven transmission portion 69 to a separation cam engagement portion 56 near the intermediate transfer unit 50 via a gear train 57. The driving force is branched to the other end portion of the intermediate transfer belt 10 through the axis before the driving force is transmitted from the separation cam engagement portion 56 to the gear in the intermediate transfer unit 50 and then transmitted onto the axis of a driver roller 13. The driving force is then transmitted to the separation cam receiver 54 and the separation cam 53 via the separation gear 58 provided on each end of the axis of the driver roller 13 illustrated in FIGS. 3A to 3E. The configuration of the separation cam 53 is as described above in detail with reference to FIGS. 2A to 2C.

The speed reduction ratio from the fixing cam 67 to the separation cam 53 is 1:1. That is, when the fixing nip pressure is in a printable state, the secondary transfer roller 12 is in a contact state (FIG. 4A), and when the fixing nip pressure is in a released (reduced) state, the secondary transfer roller 12 is in a separation state (FIG. 4B). Thus, the pattern of the contact and separation of the secondary transfer roller 12 is determined based on the state in which the fixing nip is formed or not by the fixing roller 63 and the heating member 64 in the fixing unit 60. Thus, phase detecting unit 95, which is provided in the fixing unit 60 for detecting a phase of the fixing nip pressure, measures a current value when the fixing nip is formed and a current value when the fixing nip is not formed so as to compare a fixing phase, which forms the above-described fixing position, with a fixing nip releasing phase, which forms the above-described fixing nip releasing position. Serving as a determining unit for determining the position of the secondary transfer roller 12, the control portion 7 of the image forming apparatus can determine the contact and separation of the secondary transfer roller 12 based on the result of the comparison. As a result, there is no need to newly provide a detecting unit (additional detecting unit for the secondary transfer roller 12).

Figure 5:
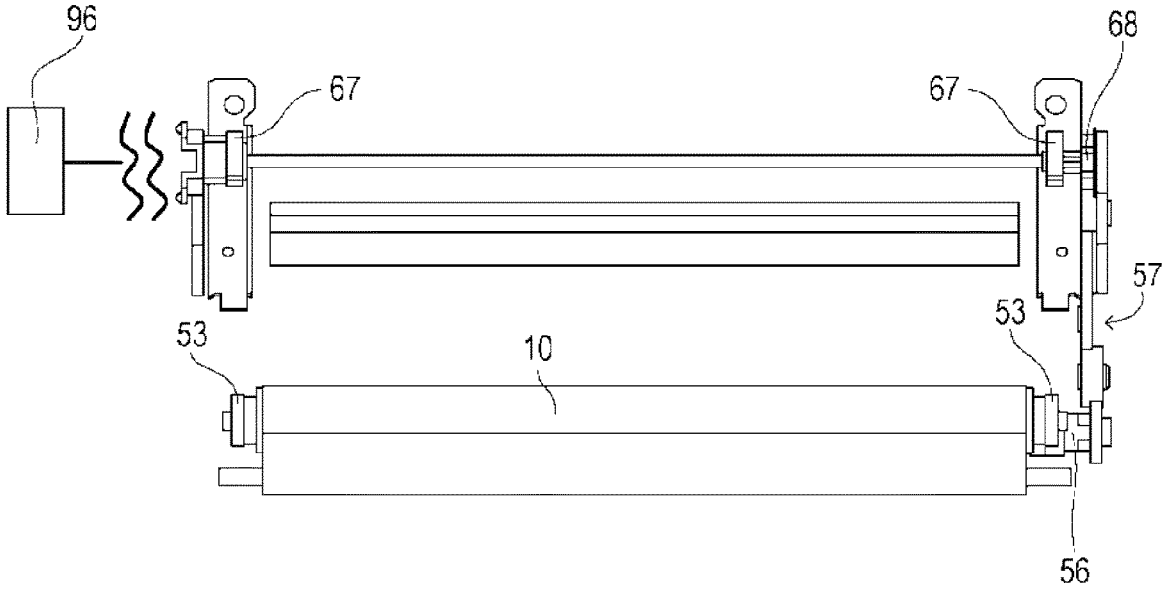
FIG. 5 is a schematic diagram illustrating a drive configuration viewed from a secondary transfer unit side according to Embodiment 1.

FIG. 5 is a schematic diagram illustrating a drive configuration viewed from the back side of the main body (the secondary transfer unit 70 side). As described above, the image forming apparatus 100 of the present embodiment includes the separation cam 53, the separation cam receiver 54, and the configuration for releasing (or reducing) the fixing nip pressure for performing the contact and separation of the secondary transfer roller 12. Furthermore, a driving force is transmitted from the fixing cam 67 to the separation cam 53 to perform the operations in conjunction with each other so that the separation of the secondary transfer roller 12 can be achieved without deteriorating the operating force (usability) and the locking performance. In addition, by adopting the configuration in which the separation cam 53 rotates as the secondary transfer unit 70 is opened, a load generated when the secondary transfer unit 70 is closed can be reduced without increasing the size of the image forming apparatus 100. Further, as described above, there is no need to newly provide a detecting unit for detecting the contact and separation of the secondary transfer roller 12.

As a result, an image defect caused by local deformation of the secondary transfer roller 12 and the intermediate transfer belt 10 due to a long-term storage can be reduced. In addition, the separation of the secondary transfer roller 12 can also be utilized at the time of shipment from the factory. When cleaning of the intermediate transfer belt 10 is needed due to no paper, paper delay, or the like, by separating the secondary transfer roller 12 from the intermediate transfer belt 10, toner adhesion to the secondary transfer roller 12 can be avoided more reliably.

While the speed reduction ratio from the fixing cam 67 to the separation cam 53 is 1:1 in the present embodiment, the ratio is not limited to 1:1. As long as the speed reduction ratio is an integer ratio, how frequent the secondary transfer roller 12 is brought into contact with and separated from the intermediate transfer belt 10 stretched on the driver roller 13 can be determined with respect to the number of operations of the fixing roller 63 and the heating member 64. Thus, by determining the contact and separation of the secondary transfer roller 12 based on the current value when the fixing nip is formed, the current value when the fixing nip is not formed, and intervals of change in the current values, the configuration can be made without newly providing a detecting unit. In addition, while the separation cam 53 is disposed on the axis of the driver roller 13, the separation cam 53 may be disposed near the driver roller 13.

It is known that the maximum load (torque peak) is commonly generated immediately before reaching the largest diameter of the cam. For example, assuming that the maximum load (the maximum torque) of the fixing cam 67 generated when the fixing nip pressure is released is 2 kgf cm, and the maximum load (the maximum torque) of the separation cam 53 generated when the secondary transfer roller 12 is separated is 1 kgf cm, in this case, if the separation cam 53 and the fixing cam 67 have the same shape, since the torque peak is commonly generated immediately before reaching the largest diameter of the cam, the torque peaks of the separation cam 53 and the fixing cam 67 overlap with each other (are simultaneously reached). As a result, the maximum load will be 3 kgf cm.

However, in the present embodiment, the shapes of the separation cam 53 and the fixing cam 67 are devised. As illustrated in FIG. 3B, when the fixing cam 67 is at the phase where the maximum load is generated immediately before reaching the largest outer diameter (rotated approximately 126 degrees from the state in FIG. 3A), the separation cam 53 is at the phase where the largest outer diameter is yet to be reached, and therefore, the maximum load is not yet generated. The fixing cam 67 rotates counterclockwise, whereas the separation cam 53 rotates clockwise. The maximum load of the separation cam 53 is arranged to be generated after the maximum load of the fixing cam 67 has been generated.

As described above, by devising the respective shapes of the separation cam 53 and the fixing cam 67, a timing difference is given between the timing of the maximum load generated for releasing the fixing nip and the timing of the maximum load generated for separating the secondary transfer roller 12. As a result, the maximum load on a motor 96, which is a drive source, can be reduced, and the selection of the motor can be optimized. In addition, the two separation cams 53 may have different shapes so that the maximum load can be reduced. Furthermore, as with the separation cam 53 of the present embodiment, by having a shape such that the radius from the rotation center of the cam to the contact region with the bearing 71 gradually changes in the rotation, the sound generated when the secondary transfer roller 12 comes into contact with the intermediate transfer belt 10 can be reduced.

Embodiment 2

Figure 6:
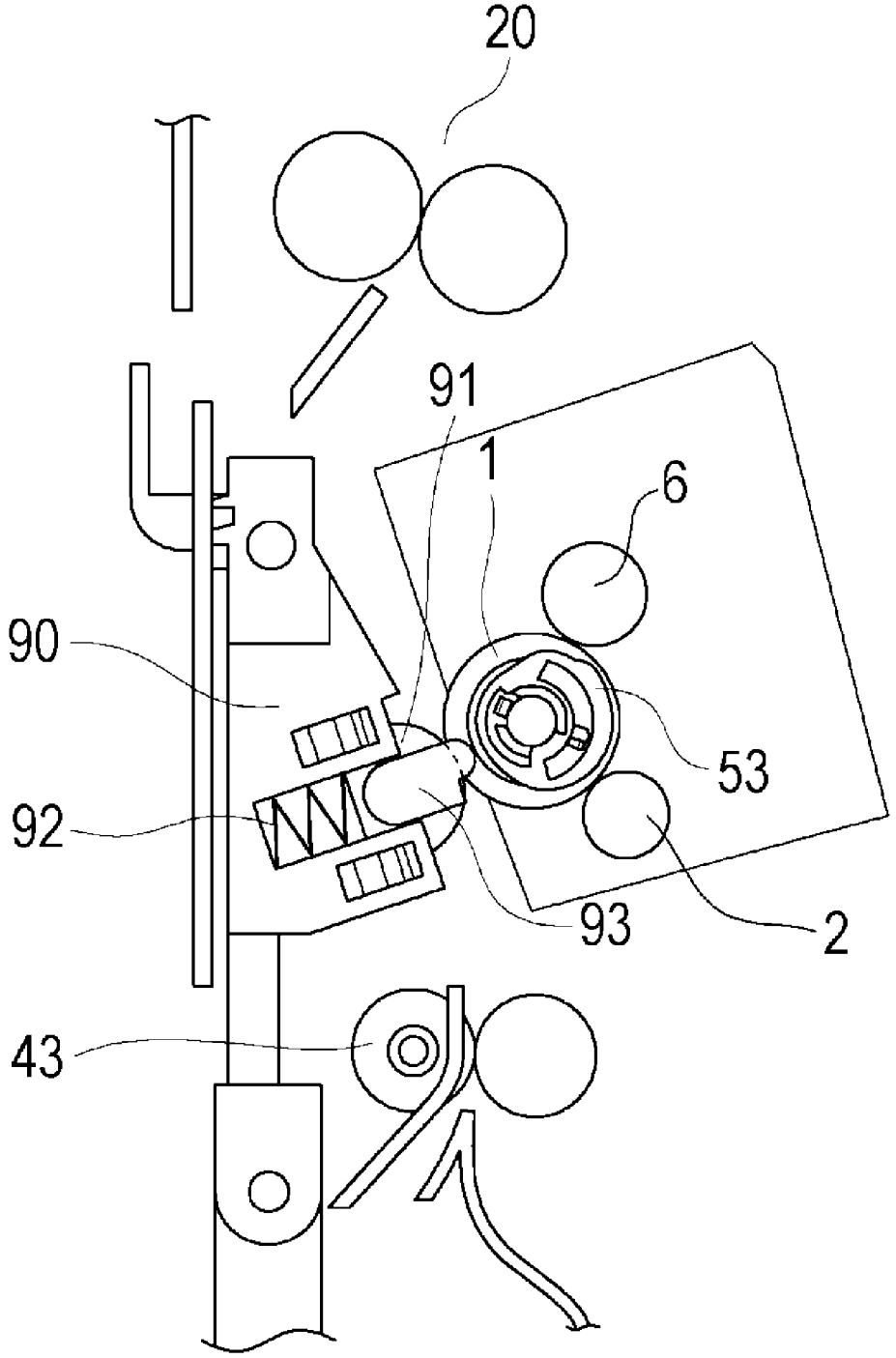
FIG. 6 is a diagram illustrating the vicinity of a transfer roller 91 according to Embodiment 2.

Next, a configuration specific to Embodiment 2 will be described with reference to FIG. 6. FIG. 6 is a diagram illustrating the vicinity of a transfer roller 91 in an image forming apparatus according to the present invention.

The image forming apparatus according to the present embodiment is a monochrome printer. A photosensitive drum 1 is disposed at a position opposed to the transfer roller 91 and forms a nip with the transfer roller 91. Separation cams 53 for separating the transfer roller 91 are provided near both ends of the photosensitive drum 1.

The transfer unit 90 includes the transfer roller 91 and bearings 93, each of which is provided at one end of the transfer roller 91 and has a surface to be in contact with a corresponding one of the separation cams 53 as described in Embodiment 1. One of the bearings 93 at both ends of the transfer roller 91 is provided with a conductive member (not illustrated) for applying a bias to the transfer roller 91. Thus, this bearing 93 is not a component identical to the other bearing 93.

The transfer roller 91 is pressed by a transfer spring 92 as a transfer biasing member via the bearing 93 and the conductive member (not illustrated), and the transfer unit 90 receives a reaction force of the transfer spring 92. The transfer unit 90 is configured to be turnable (movable between a closed position that closes the inside of the apparatus main body and an open position that exposes the inside of the apparatus main body) so that the transfer unit 90 can be opened and closed with respect to the main body of the image forming apparatus. When a paper jam or the like occurs, the inside of the apparatus main body can be exposed by moving the transfer unit 90 to the open position so as to allow a user to handle the paper jam. By turning the separation cams 53 serving as a transfer nip control member while the transfer unit 90 is closed, as in Embodiment 1 the bearings 93 move forward or backward against a bias force of the transfer spring 92 by the pressing force received from the separation cams 53. This allows the transfer roller 91 to move to a contact position (transfer position) and to a separation position (transfer nip releasing position). A configuration of the individual separation cam 53 is the same as that in Embodiment 1 described in detail with reference to FIGS. 2A to 2C.

A paper feed device (not illustrated) is provided upstream of the transfer unit 90, and a fixing unit 20 is provided downstream of the transfer unit 90 in a paper convey direction. A paper sheet that has been fed is conveyed to the nip portion formed by the photosensitive drum 1 and the transfer roller 91 to have a toner image transferred thereon, conveyed to the fixing unit 20 to have the toner image fixed thereon, and then discharged.

Figure 7:
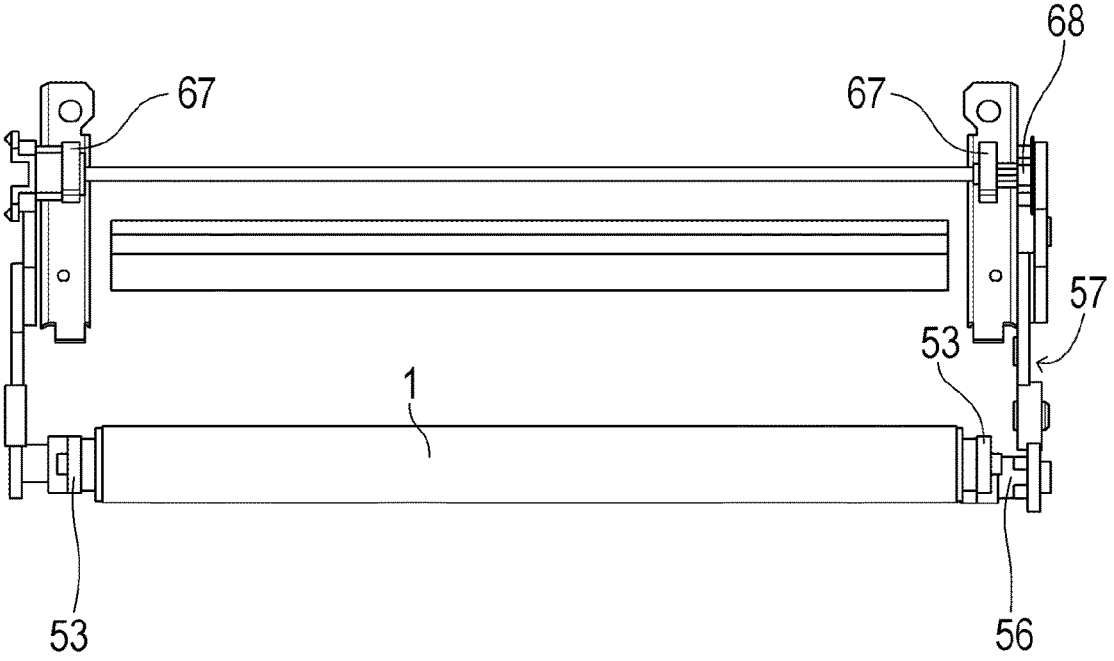
FIG. 7 illustrates a drive configuration of a separation cam according to Embodiment 2.

An operation and a drive configuration of the separation cam 53 are similar to Embodiment 1. That is, the separation cam 53 is driven by a driving force received from the fixing cam 67. The drive configuration is similar to that illustrated in FIG. 5. Alternatively, a driving force may be transmitted to both the separation cams 53 from the respective fixing cams 67 provided on both ends as illustrated in FIG. 7.

An operation of the contact and separation of the transfer roller 91 is similar to that of the secondary transfer roller 12 illustrated in FIGS. 3A to 3E in Embodiment 1.

As described above, the image forming apparatus of the present embodiment, too, includes the separation cam 53, a separation cam receiver 54, and a configuration for releasing (or reducing) the fixing nip pressure for performing the contact and separation of the transfer roller 91. Furthermore, a driving force is transmitted from the fixing cam 67 to the separation cam 53 to perform the operations in conjunction with each other so that the separation of the transfer roller 91 can be achieved without deteriorating the operating force (usability) and the locking performance. In addition, by adopting the configuration in which the separation cam 53 rotates as the transfer unit 90 is opened, a load generated when the transfer unit 90 is closed can be reduced without increasing the size of the image forming apparatus. Further, there is no need to newly provide a detecting unit for detecting the contact and separation of the transfer roller 91.

As a result, an image defect caused by local deformation of the transfer roller 91 due to a long-term storage can be reduced. In addition, the separation of the transfer roller 91 can be utilized at the time of shipment from the factory. When cleaning of the photosensitive drum 1 is needed due to no paper, paper delay, or the like, by separating the transfer roller 91 from the photosensitive drum 1, toner adhesion to the transfer roller 91 can be avoided more reliably.

While the speed reduction ratio from the fixing cam 67 to the separation cam 53 is 1:1 in the present embodiment, the ratio is not limited to 1:1. As long as the speed reduction ratio is an integer ratio, how frequent the transfer roller 91 is brought into contact with and separated from the photosensitive drum 1 can be determined with respect to the operation of the fixing unit 20, as in Embodiment 1. Thus, by determining the contact and separation of the transfer roller 91 based on the current value when the fixing nip is formed, the current value when the fixing nip is not formed, and intervals of change in the current values, the image forming apparatus of the present embodiment can be configured without newly providing a detecting unit. In addition, while the separation cam 53 is disposed on the axis of the photosensitive drum 1, the separation cam 53 may be disposed near the photosensitive drum 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-109097, filed on Jun. 24, 2020, which is hereby incorporated by reference herein in its entirety.

What is claimed is:

1. An image forming apparatus comprising:

an apparatus main body;

an image bearing member that is provided in the apparatus main body and that carries a toner image;

a transfer roller that forms a transfer nip between the transfer roller and the image bearing member to sandwich a recording material in the apparatus main body and that transfers the toner image onto the recording material;

a transfer unit that is provided in the apparatus main body to be movable to an open position in which an inside of the apparatus main body is exposed and to a closed position in which the inside of the apparatus main body is closed, and that supports the transfer roller to be movable to a transfer position in which the transfer nip is formed between the transfer roller and the image bearing member and to a transfer nip releasing position in which the transfer nip is not formed, while the transfer unit is in the closed position;

a transfer nip control member that is provided in the apparatus main body to be movable to a pressing position in which a pressing force that positions the transfer roller in the transfer nip releasing position is applied to the transfer unit in the closed position and to a releasing position in which application of the pressing force is released;

a fixing portion that includes a fixing roller which forms a fixing nip to sandwich the recording material and an opposing member which is opposed to the fixing roller, and that fixes the toner image onto the recording material; and a fixing nip control mechanism that changes a relative position between the fixing roller and the opposing member to a fixing position in which the fixing nip is formed and to a fixing nip releasing position in which the fixing nip is not formed, wherein the image forming apparatus includes an interlocking mechanism that moves the transfer nip control member from the releasing position to the pressing position in conjunction with a fixing nip releasing operation by the fixing nip control mechanism, and wherein, when the transfer unit moves from the closed position to the open position in a state where the transfer nip control member is in the pressing position, the transfer nip control member moves from the pressing position to the releasing position.

2. The image forming apparatus according to claim 1, further comprising:

a detecting unit for detecting whether the relative position between the fixing roller and the opposing member is the fixing position or the fixing nip releasing position; and a determining unit for determining whether the transfer roller is in the transfer position or the transfer nip releasing position, wherein, when the detecting unit detects that the relative position is the fixing nip releasing position, the determining unit determines that the transfer roller is in the transfer nip releasing position.

3. The image forming apparatus according to claim 1, further comprising:

a biasing unit for applying a biasing force, which positions the transfer nip control member in the releasing position, to the transfer nip control member; and a regulating member for regulating, when the transfer unit is in the closed position and the transfer nip control member is in the pressing position, the transfer nip control member so that the transfer nip control member remains in the pressing position against the biasing force of the biasing unit, wherein, when the transfer unit moves from the closed position to the open position, the regulating member releases the regulating.

4. The image forming apparatus according to claim 3, wherein the image bearing member is a belt that carries a toner image, wherein the image forming apparatus further comprises an opposing roller that is disposed on an inner surface side of the belt and that sandwiches the belt between the opposing roller and the transfer roller located on an outer surface side of the belt to form the transfer nip between the belt and the transfer roller, and wherein the transfer nip control member is a cam member, which rotates around a rotational axis coaxial with the opposing roller, and has a cam shape having a pressing phase as the pressing position and a releasing phase as the releasing position.

5. The image forming apparatus according to claim 4, wherein the biasing unit includes a cam-receiving member that is disposed coaxially with the cam member as the transfer nip control member and a biasing member that generates a biasing force between the cam member and the cam-receiving member in a rotational direction.

6. The image forming apparatus according to claim 4, wherein the fixing nip control mechanism includes a fixing cam member having a cam shape that periodically changes a relative position between the fixing roller and the opposing member to the fixing position and to the fixing nip releasing position, and wherein a speed reduction ratio from the fixing cam member to the cam member as the transfer nip control member is an integer ratio.

7. The image forming apparatus according to claim 6, further comprising:

a detecting unit for detecting whether a rotational phase of the fixing cam member is a fixing phase forming the fixing position or a fixing nip releasing phase forming the fixing nip releasing position; and a determining unit for determining whether a rotational phase of the cam member as the transfer nip control member is the pressing phase or the releasing phase, wherein, when the detecting unit detects that a rotational phase of the fixing cam member is the fixing nip releasing phase, the determining unit determines that the rotational phase of the cam member is the releasing phase.

8. The image forming apparatus according to claim 3, wherein the image bearing member is a photosensitive drum, and wherein the transfer nip control member is a cam member, which rotates around a rotational axis coaxial with the photosensitive drum, and has a cam shape having, as rotational phases, a pressing phase as the pressing position and a releasing phase as the releasing position.

9. The image forming apparatus according to claim 1, wherein the transfer unit includes a transfer biasing member that applies a biasing force, which positions the transfer roller in the transfer position, to the transfer roller, wherein the fixing portion includes a fixing biasing member that applies a biasing force, which positions the fixing roller and the opposing member in the fixing position, to the fixing roller and/or the opposing member, and wherein the interlocking mechanism causes operations of the fixing nip control mechanism and the transfer nip control member to be performed in conjunction with each other so as to avoid overlapping a timing at which a maximum load is generated when the fixing nip control mechanism moves the fixing roller and the opposing member from the fixing position to the fixing nip releasing position against a biasing force of the fixing biasing member with a timing at which a maximum load is generated when the transfer nip control member moves the transfer roller from the transfer position to the transfer nip releasing position against a biasing force of the transfer biasing member.

10. The image forming apparatus according to claim 1, further comprising a locking mechanism that has an engaging portion to engage with the transfer unit so that the transfer unit is locked in the closed position, and is configured to cause the transfer unit to reach a position, where the transfer unit is to be engaged with the engaging portion, by moving the transfer unit from the open position to the closed position.

* * * * *